US012427561B1

(12) United States Patent
Yan et al.

(10) Patent No.: US 12,427,561 B1
(45) Date of Patent: Sep. 30, 2025

(54) ELECTRICALLY-ASSISTED TOOTH-SHAPED ROLLING PROCESS AND DEVICE FOR PREPARING GRADIENT ULTRAFINE-GRAINED SHEET

(71) Applicant: Hefei University of Technology, Hefei (CN)

(72) Inventors: Siliang Yan, Hefei (CN); Lanqing Yang, Chongqing (CN); Xiaoli Zhang, Hangzhou (CN); Miao Meng, Hefei (CN); Yuhong Gong, Jinzhong (CN); Kemin Xue, Hefei (CN)

(73) Assignee: Hefei University of Technology, Hefei (CN)

( * ) Notice: Subject to any disclaimer, the term of this patent is extended or adjusted under 35 U.S.C. 154(b) by 0 days.

(21) Appl. No.: 19/214,067

(22) Filed: May 21, 2025

(30) Foreign Application Priority Data

Sep. 9, 2024 (CN) ..... 202411254423.6

(51) Int. Cl.

| | |
|---|---|
| ***B21B 1/38*** | (2006.01) |
| ***B21B 27/00*** | (2006.01) |
| ***B21B 27/06*** | (2006.01) |
| ***B21B 37/58*** | (2006.01) |
| ***B21B 37/74*** | (2006.01) |

(52) U.S. Cl.
CPC ..... *B21B 1/38* (2013.01); *B21B 27/005* (2013.01); *B21B 27/06* (2013.01); *B21B 37/58* (2013.01); *B21B 37/74* (2013.01)

(58) Field of Classification Search
CPC ..... B21B 1/38; B21B 27/005; B21B 27/06; B21B 37/58; B21B 37/74
See application file for complete search history.

(56) References Cited

U.S. PATENT DOCUMENTS

| | | | | |
|---|---|---|---|---|
| 11,519,062 | B2 * | 12/2022 | Chen | F42B 1/036 |
| 12,000,057 | B2 * | 6/2024 | Lu | C25C 7/06 |
| 12,109,598 | B1 * | 10/2024 | Liu | C22F 1/06 |
| 2024/0158899 | A1 * | 5/2024 | Beura | C22F 1/04 |

* cited by examiner

*Primary Examiner* — Jason L Vaughan

(57) ABSTRACT

An electrically-assisted tooth-shaped rolling process and device for preparing a gradient ultrafine-grained sheet is provided. A rib-forming pressure roller, a rib-flatting pressure roller and a straightening pressure roller are adopted to sequentially roll relative to a surface of a sheet under a preset pressing force. The surface of the sheet is driven, under a rib forming process, to generate large deformation in micro-area to crush and refine grains, and under a rib flatting process to generate reverse large deformation in micro-area. Large deformation areas in the rib forming process and the rib flatting process are staggered to further crush and refine the grains. A cold straightening process drives the sheet to be restored to an original shape, so that the sheet becomes the gradient ultrafine-grained sheet with a decreasing grain size gradient from an interior to a surface layer.

10 Claims, 9 Drawing Sheets

ELECTRICALLY-ASSISTED TOOTH-SHAPED ROLLING PROCESS AND DEVICE FOR PREPARING GRADIENT ULTRAFINE-GRAINED SHEET

CROSS-REFERENCE TO RELATED APPLICATION

This application claims priority to Chinese Patent Application No. 202411254423.6, filed on Sep. 9, 2024, which is herein incorporated by reference in its entirety.

TECHNICAL FIELD

The disclosure relates to the field of metal plastic forming technology, and more particularly to an electrically-assisted tooth-shaped rolling process and device for preparing a gradient ultrafine-grained sheet.

BACKGROUND

Strengthening and toughening of metal parts have always been key issues in scientific research and engineering applications in the fields of new materials and advanced manufacturing. In recent decades, scholars at home and abroad have strengthened metal materials by various means (such as solid solution strengthening, fine grain strengthening, deformation strengthening, dispersion strengthening and their composite strengthening means), and have found that when a grain size of the metal materials is refined to nanometer level, strength and hardness of the metal materials can be increased several times, but plasticity of the metal materials is significantly reduced, that is, a problem of "inversion of strength and plasticity" appears. The problem limits application of the metal materials in severe service environments such as heavy load, high impact and complex alternating stress. Many scholars, represented by a research team led by Academician Lu Ke from the Institute of Metal Research, Chinese Academy of Sciences, have found that metal materials with gradient nanostructures can break a law of "increase in strength, decrease in plasticity and toughness" in homogeneous structural materials, making an introduction of gradient nanocrystals/ultrafine-grained structure into the metal materials become a research hotspot in the fields of materials science, solid mechanics and forming and manufacturing science in recent years. Compared with single structural materials, multi-level nanocrystals/ultrafine-grained materials can coordinate with each other through structures with different feature sizes during a deformation process, introduce a back-stress strengthening effect to further optimize mechanical properties of materials, and produce synergistic strengthening in terms of strength and ductility, therefore characteristics of surface strength, fatigue resistance, wear resistance, corrosion resistance and other properties can also be improved to a certain extent. Based on the characteristics, design of high-performance materials in related art can get rid of relying too much on "alloying" or composition control. By subjecting low-cost metal materials to gradient nanocrystals/ultrafine-grained treatment, mechanical properties of the low-cost metal materials can even achieve or exceed that of high-cost multi-component alloy materials, therefore achieving "elementarization" modification of materials, so as to reduce production and preparation costs of materials, decrease consumption of rare and precious metal resources and energy, and enhance feasibility of material recycling.

Technologies for preparing a gradient ultrafine-grained sheet mainly includes three major categories: a physical and chemical deposition method; a large plastic deformation method; and an energy field assisted processing method. The physical and chemical deposition method includes electrodeposition, magnetron sputtering, etc. The physical and chemical deposition method has characteristics of high requirements for equipment, complex process flow, thin gradient layer and long preparation time, and is mainly used to prepare thin film materials, therefore limiting large-scale application thereof. In related art, the physical and chemical deposition method is only used in laboratory scientific research process and has not yet been applied in industry.

The large plastic deformation method or surface large plastic deformation method includes surface mechanical rolling, surface rolling, high-pressure surface rolling, rapid rotary rolling, accumulative stacked rolling and composite annealing, die pressing, friction stir processing, etc. For some difficult-to-deform sheets, the large plastic deformation method has some process defects, such as unsuitable shape (surface mechanical rolling and surface rolling), difficulty in preparing gradient structure (die pressing, friction stir processing), serious thinning (surface rolling, high-pressure surface rolling and rapid rotary rolling), surface integrity damage (friction stir processing and surface mechanical rolling), and difficulty in forming and even cracking (die pressing, friction stir processing, high-pressure surface rolling, etc.). The above process methods are relatively easy to achieve engineering application.

The energy field assisted processing method is equivalent to applying a special energy field to the large plastic deformation method, and utilizes special multi-scale effects of the energy field to improve preparation effect. Representative technologies of the energy field assisted processing method include laser shock strengthening (i.e. laser blasting) and ultrasonic rolling. The laser shock strengthening can cause excessive thermal damage and local deformation of a sheet. The ultrasonic rolling can achieve mirror processing when applied to large-size sheets, but a modification efficiency is low, and a preparation process of large-size gradient ultrafine-grained sheets is long.

For difficult-to-deform alloy sheets (such as TC4 (Ti-6Al-4V) alloy, a GH4169 (also referred to as Inconel 718) sheet, and a Ti2AlNb-based alloy sheet) needed in an aerospace field to prepare complex skin and wall plane components, in order to further improve their service performance, corresponding preparation or modification methods for gradient nanocrystals/ultrafine-grained sheets are urgently required. However, aforementioned materials have high deformation resistance, are prone to cracking, and have serious deformation springback at room temperature, making it difficult for processes in related art to achieve high-performance and short-process preparation of such sheets.

SUMMARY

The disclosure aims to provide a process and a device to achieve high-performance and short-process preparation of a gradient ultrafine-grained sheet made of difficult-to-deform materials to prepare an advanced material with good strength-plasticity matching namely the gradient ultrafine-grained sheet, so as to address a demand for high-quality sheets to enhance service performance of high-performance and complex sheet-made components (such as fuselage and wing skins, inlet skins, fuselage and hatch door panels of advanced fighter aircraft, and Bump inlet skins of hypersonic vehicles) made of the difficult-to-deform materials in an aerospace field.

To solve aforementioned problems, the disclosure provides technical solutions as follows.

An electrically-assisted tooth-shaped rolling process for preparing a gradient ultrafine-grained sheet, including the following steps:

S1, polishing a surface of a raw sheet to obtain a polished sheet; and then cutting the polished sheet to form a prefabricated sheet with a preset target shape;

S2, fixedly placing the prefabricated sheet in a forming groove with a shape matched with the preset target shape of the prefabricated sheet; setting current parameters of a pulse power generator; and connecting the prefabricated sheet with a power output terminal of the pulse power generator;

S3, connecting a rib-forming pressure roller with another power output terminal of the pulse power generator, the rib-forming pressure roller being located above the prefabricated sheet and having convex-concave textures on a cylindrical surface thereof; driving, by a pressurizing device, the rib-forming pressure roller to move downward until the cylindrical surface of the rib-forming pressure roller is in contact with an end of a surface of the prefabricated sheet to apply a first preset pressing force onto the prefabricated sheet;

S4, driving, by a horizontal displacement device, the forming groove and the prefabricated sheet to move horizontally, thereby causing the rib-forming pressure roller to roll relative to the surface of the prefabricated sheet until the rib-forming pressure roller disengages from another end of the surface of the prefabricated sheet; in which, in a relative rolling process between the rib-forming pressure roller and the prefabricated sheet, pressing ribs on the cylindrical surface of the rib-forming pressure roller sequentially contact with different positions on the surface of the prefabricated sheet, local heating is caused at the different positions on the surface of the prefabricated sheet due to passage of current; and after the relative rolling process between the rib-forming pressure roller and the prefabricated sheet is completed, concave-convex textures are formed on the surface of the prefabricated sheet to thereby obtain a first loading step formed sheet with the concave-convex textures on a surface thereof;

S5, connecting a rib-flatting pressure roller with the another power output terminal of the pulse power generator, rib-flatting pressure roller being located above the first loading step formed sheet and having a smooth cylindrical surface; and driving, by the pressurizing device, the rib-flatting pressure roller to move downward until the cylindrical surface of the rib-flatting pressure roller is in contact with an end of the surface of the first loading step formed sheet to apply a second preset pressing force onto the first loading step formed sheet;

S6, driving, by the horizontal displacement device, the forming groove and the first loading step formed sheet to move horizontally, thereby causing the rib-flatting pressure roller to roll relative to the surface of the first loading step formed sheet until the rib-flatting pressure roller disengages from another end of the first loading step formed sheet; in which, in a relative rolling process between the rib-flatting pressure roller and the first loading step formed sheet, the smooth cylindrical surface of the rib-flatting pressure roller sequentially contacts with convex parts at different positions on the surface of the first loading step formed sheet, and local heating is generated at the different positions on the surface of the first loading step formed sheet due to passage of current, and after the relative rolling process between the rib-flatting pressure roller and the first loading step formed sheet is completed, the concave-convex textures on the surface of the first loading step formed sheet are restored to a plane shape to thereby obtain a second loading step formed sheet;

S7, driving, by the pressurizing device, a straightening pressure roller with a smooth cylindrical surface and located above the second loading step formed sheet to move downward until the smooth cylindrical surface of the straightening pressure roller is in contact with an end of a surface of the second loading step formed sheet to apply a third preset pressing force onto the second loading step formed sheet;

S8, driving, by the horizontal displacement device, the forming groove and the second loading step formed sheet to move horizontally, thereby causing the straightening pressure roller to roll relative to the surface of the second loading step formed sheet until the straightening pressure roller disengages from another end of the second loading step formed sheet; and performing, by the smooth cylindrical surface of the straightening pressure roller, cold straightening on the surface of the second loading step formed sheet to adjust a flatness of the surface of the second loading step formed sheet;

S9, repeating step S3 to step S8 for a preset number of cycles to complete a multi-pass rolling forming process so as to obtain the gradient ultrafine-grained sheet; and

S10, turning off the pulse power generator, resetting the pressurizing device and the horizontal displacement device, and removing the gradient ultrafine-grained sheet from the forming groove.

In an embodiment, in the step S2, the current parameters of the pulse power generator are set as follows: 500 Hertz (Hz) of a frequency, 20 amperes per square millimeter ($A/mm^2$)-30 $A/mm^2$ of a current density, and 75 microseconds (μs) of a duty cycle.

In an embodiment, after the local heating is caused at the different positions on the surface of the prefabricated sheet due to the passage of current, a temperature at the different positions on the surface of the prefabricated sheet is in a range of 500 Celsius Degrees (° C.)-800° C.

In an embodiment, in the step S6, after the local heating is caused at the different positions on the surface of the first loading step formed sheet due to the passage of current, a temperature at the different positions on the surface of the first loading step formed sheet is in a range of 500° C.-800° C.

In an embodiment, a radius difference of the convex-concave textures on the cylindrical surface of the rib-forming pressure roller is in a range of ¼-⅓ of a thickness of the prefabricated sheet.

The disclosure further provides an electrically-assisted tooth-shaped rolling device for preparing the gradient ultrafine-grained sheet. The electrically-assisted tooth-shaped rolling device is applied to perform the aforementioned electrically-assisted tooth-shaped rolling process for preparing the gradient ultrafine-grained sheet. The electrically-assisted tooth-shaped rolling device includes a bottom plate, a top plate and the pulse power generator; the top plate is fixedly disposed above the bottom plate through support columns; a linear assembly and supporting rails are fixedly disposed on a top surface of the bottom plate, and the supporting rails are respectively disposed at two sides of the linear assembly; the forming groove is fixedly connected to a power output end on a top of the linear assembly; a bottom surface of the forming groove is sliding overlapped on tops of the support rails; and the forming groove is configured to place the prefabricated sheet to be processed and formed;

hydraulic cylinders are fixedly disposed on a top of the top plate; output shaft ends of the hydraulic cylinders are fixedly connected to a lifting frame plate below the top plate; a pressure roller assembly is rotatably disposed on the lifting frame plate and a pressure roller position-switching power device is fixedly disposed on the lifting frame plate; the pressure roller assembly includes a position-switching rotating shaft rotatably connected to a bottom part of the lifting frame plate, two position-switching rotating plates respectively fixedly disposed on journals of the position-switching rotating shaft at both ends of the position-switching rotating shaft, the rib-forming pressure roller, the rib-flatting pressure roller and the straightening pressure roller; each of the rib-forming pressure roller, the rib-flatting pressure roller and the straightening pressure roller is rotatably disposed between the two position-switching rotating plates; axes of the rib-forming pressure roller, the rib-flatting pressure roller and the straightening pressure roller are circumferentially and evenly distributed around an axis of the position-switching rotating shaft; the rib-forming pressure roller is provided with the convex-concave textures on the cylindrical surface thereof; and each of the rib-flatting pressure roller and the straightening pressure roller has the smooth cylindrical surface;

power output ends of the pressure roller position-switching power device (i.e., second transmission gears) are transmission-connected to ends of the position-switching rotating shaft; and the pressure roller position-switching power device is configured to drive the rib-forming pressure roller, the rib-flatting pressure roller and the straightening pressure roller to be sequentially positioned below the position-switching rotating shaft and right above an end of a top surface of the prefabricated sheet; and the forming groove is electrically connected with the power output terminal of the pulse power generator; the rib-forming pressure roller and the rib-flatting pressure roller are both electrically connected with the another power output terminal of the pulse power generator; the hydraulic cylinders are configured to drive the pressure roller assembly to move downward, to thereby make outer cylindrical surface of any one of the rib-forming pressure roller, the rib-flatting pressure roller and the straightening pressure roller below the position-switching rotating shaft be in contact with the surface of the prefabricated sheet, and apply a preset pressing force onto the prefabricated sheet; and the linear assembly is configured to drive the forming grove and the prefabricated sheet to move horizontally, to thereby make any one of the rib-forming pressure roller, the rib-flatting pressure roller and the straightening pressure roller be in contact with the surface of the prefabricated sheet roll relative to the surface of the prefabricated sheet.

In an embodiment, the pressure roller position-switching power device includes:

a position-switching drive motor, fixedly disposed on a bottom surface on a top of the lifting frame plate;

a transmission rotating shaft, rotatably connected to the lifting frame plate;

a driving bevel gear, fixedly connected to an output shaft end of the position-switching drive motor;

a driven bevel gear, fixedly connected to the transmission rotating shaft and meshed with the driving bevel gear;

first transmission gears, fixedly connected to journals of the transmission rotating shaft; and the second transmission gears, fixedly connected to journals of the position-switching rotating shaft; in which the second transmission gears are disposed outside the two position-switching rotating plates and meshed with the first transmission gears.

In an embodiment, locking mechanisms are fixedly disposed on the lifting frame plate; the locking mechanisms include locking cylinders fixedly disposed on a top surface of the lifting frame plate and locking plug rods fixedly connected to output shaft ends of the locking cylinders. Plug connectors are disposed on bottom ends of the locking plug rods. An outer edge surface of each of the two position-switching rotating plates defines three plug-in grooves, and each of the three plug-in grooves is matched with each of the plug connectors and each of the plug connectors is capable of being inserted into any one of the three plug-in grooves. The three plug-in grooves are circumferentially and evenly distributed around the axis of the position-switching rotating shaft.

In an embodiment, axial lengths of the rib-forming pressure roller, the rib-flatting pressure roller and the straightening pressure roller are equal. Radii of outer circular surfaces of the rib-forming pressure roller, the rib-flatting pressure roller and the straightening pressure roller are equal. The axial lengths are all not less than an inner width of the forming groove.

In an embodiment, a pattern of the convex-concave textures on the cylindrical surface of the rib-forming pressure roller is any one selected from the group consisting of a straight-toothed pattern, an oblique-toothed pattern, a crossed mesh-toothed pattern, and a wolf-toothed pattern.

Compared with technologies in related art, the disclosure has the following beneficial effects.

1. The electrically-assisted tooth-shaped rolling process and device for preparing the gradient ultrafine-grained sheet adopts the rib-forming pressure roller with pressing ribs on the cylindrical surface thereof, the rib-flatting pressure roller with the smooth cylindrical surface and the straightening pressure roller with the smooth cylindrical surface to sequentially roll relative to the surface of a sheet under the preset pressing force to complete rolling processes. During a rib forming process, large deformation in micro-area occurs on the surface of the sheet, resulting in local large plastic deformation to crush and refine grains. During a rib flatting process, reverse large deformation in micro-area occurs on the surface of the sheet, resulting in local large plastic deformation. Large deformation areas in the rib forming process and the rib flatting process are staggered to further crush and refine the grains and restore the surface of the sheet to the plane shape. During a cold straightening process, a whole body of the sheet is restored to an original shape of the sheet, so that a structure of the sheet becomes a gradient ultrafine-grained structure with a decreasing grain size gradient from an interior to a surface layer. By taking three loading steps as one pass, the high-performance and short-process preparation of the gradient ultrafine-grained sheet is achieved.

2. In the electrically-assisted tooth-shaped rolling process provided by the disclosure, different types and sizes of pressing ribs can be adopted for sheets with different materials and sizes, so that a deformation state of the sheet is close to a local micro-area deformation of surface stamping during the rolling processes, so as to avoid a situation that the sheet are excessively thinned to form an irreversible shape recovery area or overall performance of the sheet is uneven after rolling.

3. In the electrically-assisted tooth-shaped rolling process provided by the disclosure, an electrically-assisted technology is applied in the rib forming process and the rib flatting process. A use of electro-plastic effect of pulse current can reduce load for local structure forming, locally improve formability of difficult-to-deform materials, promote stabilization of high-energy defects and microstructures in a local deformation area, and form a gradient ultrafine-grained structure with full recrystallization. To some extent, a Joule heating effect of the pulse current creates local temperature rise conditions in the local deformation area, therefore enhancing continuity of a gradient structure, weakening severe work-hardening effect on the surface of the sheet, and preventing formation of a work-hardened surface layer prone to embrittlement and peeling. Local formability of the sheet is increased to avoid cracks, eliminate surface texture, and optimize isotropic performance consistency of the sheet. Due to a higher temperature in a local area of the sheet, metal sheets (such as TC4 alloy, a GH4169 sheet, and a Ti2AlNb-based alloy sheet) that are difficult to deform at room temperature can be formed, thus the electrically-assisted tooth-shaped rolling process provided by the disclosure has good universality.

Figure 1:
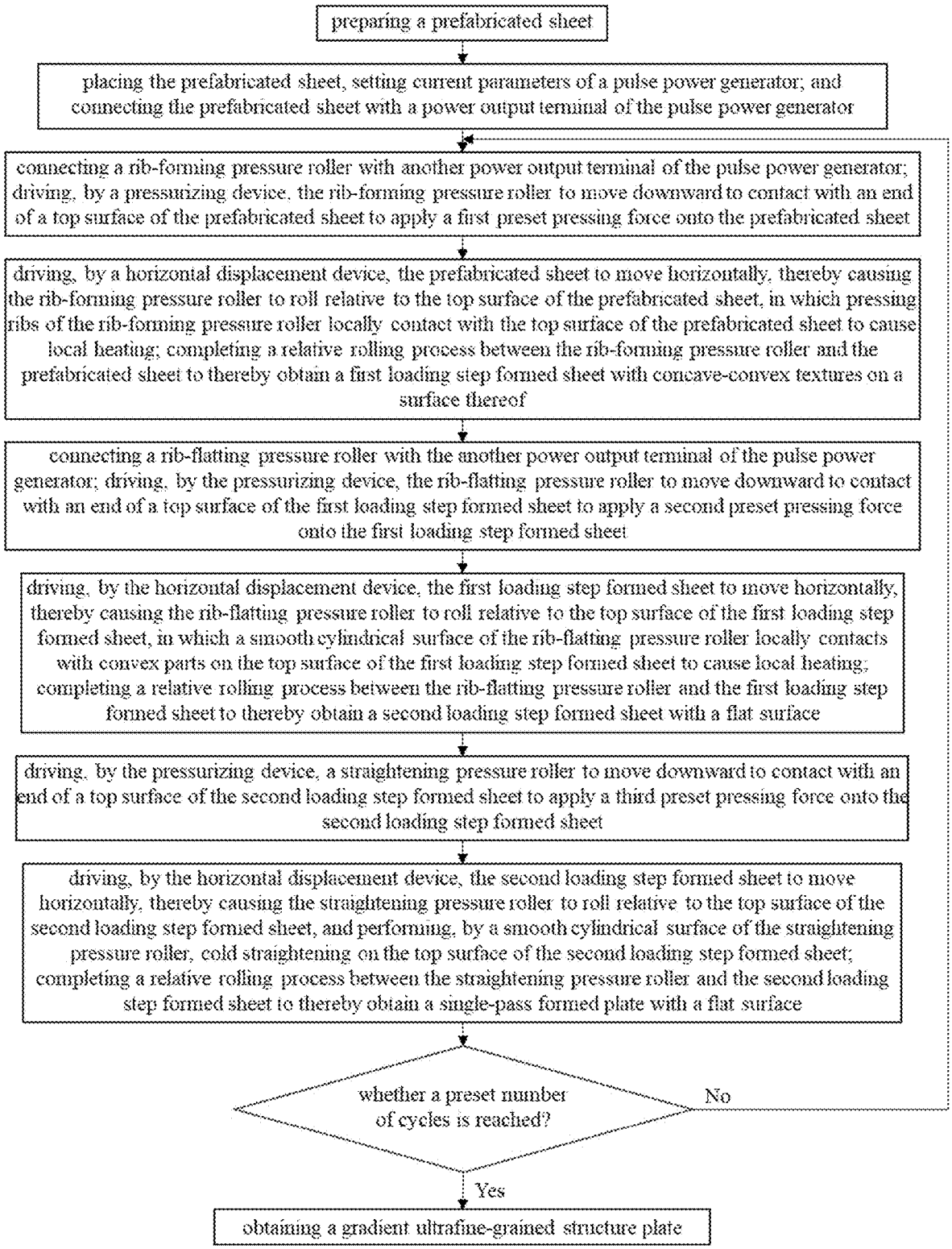
FIG. 1 illustrates a flowchart of an electrically-assisted tooth-shaped rolling process for preparation of a gradient ultrafine-grained sheet according to the disclosure.

Description of reference numerals: 1: bottom plate; 101: top plate; 102: supporting column; 2: forming groove; 201: insulating pallet; 3 hydraulic cylinder; 4: linear assembly; 401: supporting rail; 402: guiding slider; 5: pressure roller assembly; 501: position-switching rotating shaft; 502: position-switching rotating plate; 5021: plug-in groove; 503: rib-forming pressure roller; 504: rib-flatting pressure roller; 505: straightening pressure roller; 506: reinforcing rod; 6: pressure roller position-switching power device; 601: position-switching drive motor; 602: transmission rotating shaft; 603: driving bevel gear; 604: driven bevel gear; 605: first transmission gear; 606: second transmission gear; 607: motor mounting bracket; 7: lifting frame plate; 8: locking mechanism; 801: locking cylinder; 802: locking plug rod; 803: plug connector; 804: cylinder mounting seat; 805: guiding bar; 9: pulse power generator.

DETAILED DESCRIPTION OF EMBODIMENTS

Embodiments of the disclosure will be described in detail with reference to attached drawings, so that advantages and features of the disclosure can be more easily understood by those skilled in the art, and a scope of protection of the disclosure can be more clearly and unambiguously defined.

As illustrated in FIG. 1, an electrically-assisted tooth-shaped rolling process for preparing a gradient ultrafine-grained sheet includes the following steps S1 through S10.

In S1, a surface of a raw sheet is polished to obtain a polished sheet; and then the polished sheet is cut to form a prefabricated sheet with a preset target shape.

In the embodiment, the prefabricated sheet is made of TC4 alloy, rectangular in shape, with a size specification of A milometers (mm) in length, B mm in width and C mm in thickness. The surface of the raw sheet or the prefabricated sheet is performed with degreasing and finishing (such as polishing) treatments to ensure reliability of subsequent local electrification, therefore ensuring consistency of an overall roll forming effect.

In S2, the prefabricated sheet is fixedly placed in a forming groove 2 with a shape matched with the preset target shape of the prefabricated sheet. Current parameters of a pulse power generator 9 are set. The prefabricated sheet is connected with a power output terminal of the pulse power generator 9.

Due to different extrusion formability of different materials, deformation pressure and current parameters of electric auxiliary heating required in rolling deformation are different, so that optimal parameter are selected and determined through multiple groups of orthogonal experiments. In the embodiment, for the prefabricated sheet, the current parameters of the pulse power generator 9 are set as follows: 500 Hz of a frequency, 20 $A/mm^2$-30 $A/mm^2$ of a current density, and 75 us of a duty cycle. The prefabricated sheet is connected with a negative electrode (i.e., a power output terminal) of the pulse power generator 9 by an oxygen-free high-conductivity copper electrode. The forming groove 2 is configured to control a shape of the sheet during rolling processes, ensuring that a surface shape and a contour shape of a deformed sheet hardly change (without significant widening and thinning). Backing plates are disposed around a groove bottom of the forming groove 2. The backing plates are enlongated strip plates with a same material and an approximate thickness as the prefabricated sheet and located at an edge of a bottom surface of the prefabricated sheet. The backing plates are used to prevent edge ablation of a to-be-processed sheet caused by temperature concentration at electrified positions of the to-be-processed sheet during a direct contact electrification process, so as to ensure formation and uniformity of the gradient ultrafine-grained sheet.

In S3, a rib-forming pressure roller 503 is connected with another power output terminal of the pulse power generator 9, and the rib-forming pressure roller 503 is located above the prefabricated sheet and has convex-concave textures on a cylindrical surface thereof. A pressurizing device is configured to drive the rib-forming pressure roller 503 to move downward until the cylindrical surface of the rib-forming pressure roller 503 is in contact with an end of the surface of the prefabricated sheet to apply a first preset pressing force onto the prefabricated sheet.

In an embodiment, a radius difference of the convex-concave textures on the cylindrical surface of the rib-forming pressure roller 503 is in a range of ¼-⅓ of a thickness of the prefabricated sheet, so that a deformation state of the sheet is close to a local micro-area deformation of surface stamping during the rolling process, and upper convex parts on the surface of the sheet flow to concave parts in a subsequent rib-pressing loading step. In this way, a surface shape of the sheet can be well restored to the surface shape before deformation, and significant widening in a preparation process of the gradient ultrafine-grained sheet can be avoided. In the embodiment, pressing ribs on the cylindrical surface of the rib-forming pressure roller 503 adopt a cylindrical spur gear structure with micro-size teeth. Shaft ends on both sides of the rib-forming pressure roller 503 are connected with a positive electrode (i.e., another power output terminal) of the pulse power generator 9 by brushes, so as to ensure reliable electrification of the rib-forming pressure roller 503 in a relative rolling process between the rib-forming pressure roller 503 and the prefabricated sheet. The first preset pressing force is determined according to factors such as material and thickness of the sheet, and height difference of the pressing ribs, so as to ensure that local severe deformation depth of on the surface of the sheet meets depth requirement of the gradient ultrafine-grained structure.

In S4, a horizontal displacement device is configured to drive the forming groove 2 and the prefabricated sheet to move horizontally, thereby causing the rib-forming pressure roller 503 to roll relative to the surface of the prefabricated sheet until the rib-forming pressure roller 503 disengages from another end of the surface of the prefabricated sheet. In the relative rolling process between the rib-forming pressure roller 503 and the prefabricated sheet, the pressing ribs on the cylindrical surface of the rib-forming pressure roller 503 sequentially contact with different positions on the surface of the prefabricated sheet. Local heating is caused at the different positions due to passage of current. After the relative rolling process between the rib-forming pressure roller 503 and the prefabricated sheet is completed, concave-convex textures are formed on the surface of the prefabricated sheet to thereby obtain a first loading step formed sheet with the concave-convex textures on a surface thereof.

During a rib forming process, the pressing ribs on the rib-forming pressure roller 503 sequentially contact with and disengage from the surface of the prefabricated sheet, so that large deformation in micro-area occurs on the surface of the sheet, resulting in local large plastic deformation to crush and refine grains. In the embodiment, after the local heating is caused at the different positions on the surface of the prefabricated sheet due to the passage of current, a temperature at the different positions on the surface of the prefabricated sheet is in a range of 500° C.-800° C. Locally heating up the sheet to a forming temperature takes an extremely short electrification time. Therefore, controlling a speed of the horizontal displacement device driving the prefabricated sheet to move horizontally is required to control a contact time between a single rib protrusion and a single local area on the surface of the prefabricated sheet. During the relative rolling process between the rib-forming pressure roller 503 and the prefabricated sheet, only current density at the different positions between the pressing ribs and the prefabricated sheet is concentrated, and local Joule heating and electro-plastic effect at the different positions on the surface of the prefabricated sheet will be more obvious. In this way, local formability is increased to avoid cracks. A method of pulse current assisted stamping with large deformation can eliminate surface texture and is beneficial to isotropic performance consistency of the sheet. In addition, electro-plastic effect at the contact positions can promote stabilization of high-energy defects and microstructures of materials in a local deformation area, and form a gradient ultrafine-grained structure with full recrystallization. To some extent, the Joule heating effect creates local temperature rise conditions in the local deformation area, therefore enhancing the continuity of the gradient structure, weakening severe work-hardening effect on the surface of the sheet, and preventing formation of a work-hardened surface layer prone to embrittlement and peeling. After a first loading step formation, many fine concave-convex textures are rolled on the surface of the sheet.

In S5, a rib-flatting pressure roller 504 is connected with the another power output terminal of the pulse power generator 9, and the rib-flatting pressure roller 504 is located above the first loading step formed sheet and has a smooth cylindrical surface. The pressurizing device is configured to drive the rib-flatting pressure roller 504 to move downward until the smooth cylindrical surface of the rib-flatting pressure roller 504 is in contact with an end of the surface of the first loading step formed sheet to apply a second preset pressing force onto the first loading step formed sheet.

The shaft ends on both sides of the rib-flatting pressure roller 504 are connected with the positive electrode of the pulse power generator 9 by brushes, so as to ensure reliable electrification of the rib-flatting pressure roller 504 in a relative rolling process between the rib-flatting pressure roller 504 and the first loading step formed sheet. During the rib forming process and a rib flatting process, only one of the rib-forming pressure roller 503 and the rib-flatting pressure roller 504 is in contact with the sheet, and process parameters used in both processes are the same. Therefore, the brushes at both ends of the rib-forming pressure roller 503 and the rib-flatting pressure roller 504 can remain energized all time. Alternatively, after the rib-forming pressure roller 503 or the rib-flatting pressure roller 504 completes corresponding relative rolling process, power supply can be switched to the brushes at both ends of the rib-flatting pressure roller 504 or the rib-forming pressure roller 503. The second preset pressing force in the rib flatting process is the same as the first preset pressing force in the rib forming process.

In S6, the horizontal displacement device is configured to drive the forming groove 2 and the first loading step formed sheet to move horizontally, thereby causing the rib-flatting pressure roller 504 to roll relative to the surface of the first loading step formed sheet until the rib-flatting pressure roller 504 disengages from another end of the first loading step formed sheet. In the relative rolling process between the rib-flatting pressure roller 504 and the first loading step formed sheet, the smooth cylindrical surface of the rib-flatting pressure roller 504 sequentially contacts with convex parts at different positions on the surface of the first loading step formed sheet. Local heating is caused at the different positions on the surface of the first loading step formed sheet due to passage of current. After the relative rolling process between the rib-flatting pressure roller 504 and the first loading step formed sheet is completed, the concave-convex textures on the surface of the first loading step formed sheet are restored to a plane shape to thereby obtain a second loading step formed sheet.

The process parameters used in the rib forming process and the rib flatting process are the same so that the rib flatting process is a reverse process of the rib forming process. Therefore, the upper convex parts on the surface of the sheet flows to the concave parts in the rib flatting process to generate reverse large deformation in micro-area on the surface of the sheet, resulting in local large plastic deformation so as to further crush and refine the grains and restore the surface of the sheet to the plane shape.

In S7, the pressurizing device is configured to drive a straightening pressure roller 505 with a smooth cylindrical surface and located above the second loading step formed sheet to move downward until the smooth cylindrical surface of the straightening pressure roller 505 is in contact with an end of a surface of the second loading step formed sheet to apply a third preset pressing force. An objective of cold straightening is to drive the sheet to undergo forced deformation in an unheated state, therefore a pressing force used in a cold straightening process is larger than that in the rib forming process and the rib flatting process.

In S8, the horizontal displacement device is configured to drive the forming groove 2 and the second loading step formed sheet to move horizontally, thereby causing the straightening pressure roller 505 to roll relative to the surface of the second loading step formed sheet until the straightening pressure roller 505 disengages from another end of the second loading step formed sheet. The surface of the second loading step formed sheet is performed, by the smooth cylindrical surface of the straightening pressure roller 505, with cold straightening to a adjust flatness of the surface thereof.

Since the rib forming process and the rib flatting process are only carried out on an upper surface of the sheet, and the rib-forming pressure roller 503 and the rib-flatting pressure roller 504 are always in line contact with the upper surface of the sheet in a width direction, continuous local severe surface deformation can cause the sheet to warp in length direction (usually with middle part bulging upward). Performing, by the straightening pressure roller 505, cold straightening on the sheets after the rib flatting process can restore the sheet to a flat state and ensure flatness of the surface of the sheet.

In S9, step S3 to step S8 are repeated for a preset number of cycles to complete a multi-pass rolling forming process so as to obtain the gradient ultrafine-grained sheet.

To produce finer surface grains or a deeper fine grain layer, a number of loading passes can be increased in an order of aforementioned three loading steps to continuously accumulate greater local plastic deformation, therefore providing a feasible method for precisely controlling grain size and thickness of an ultrafine-grained layer.

In S10, the pulse power generator 9 is turned off. The pressurizing device and the horizontal displacement device are reset. The gradient ultrafine-grained sheet is removed from the forming groove 2.

After aforementioned rolling process, a whole surface of the sheet is subject to the large plastic deformation. A surface shape of the sheet hardly changes (without significant widening and thinning) after deformation, but the grain structure becomes gradient ultrafine-grained structure with increasing gradient from a rolled surface to the other surface. In this way, large-size sheets with high strength and toughness (gradient nano/ultrafine-grained structure has excellent strong-plastic matching) can be prepared. The electrically-assisted tooth-shaped rolling process is very extensible, and can be applied to the large-scale preparation of large-size gradient ultrafine-grained sheets.

As illustrated in FIG. 2 through FIG. 14, the disclosure provides an electrically-assisted tooth-shaped rolling device for preparing the gradient ultrafine-grained sheet. The electrically-assisted tooth-shaped rolling device is applied to aforementioned electrically-assisted tooth-shaped rolling process for preparing the gradient ultrafine-grained sheet. The electrically-assisted tooth-shaped rolling device includes a bottom plate 1, a top plate 101 and the pulse power generator 9. The top plate 101 is fixedly disposed above the bottom plate 1 through supporting columns 102, so as to form a gantry structure above the bottom plate 1.

A linear assembly 4 and supporting rails 401 are fixedly disposed on a top surface of the bottom plate 1. The linear assembly 4 is disposed on inner sides of the supporting columns 102 and the supporting rails 401 are respectively disposed at two sides of the linear assembly 4. The forming groove 2 is fixedly connected to a power output end on a top of the linear assembly 4. A bottom surface of the forming groove 2 is sliding overlapped on tops of the support rails 401. The forming groove 2 is configured to place the prefabricated sheet to be processed and formed. The linear assembly 4, the support rails 401 and the forming groove 2 constitute the horizontal displacement device. In an embodiment, an insulating support pallet 201 supported by insulating materials (such as mica) is disposed at the bottom surface of the forming groove 2. Multiple groups of guiding sliders 402 are symmetrically and fixedly connected to two sides of a bottom surface of the insulating pallet 201. Bottom surfaces of the multiple groups of guiding sliders 402 and top surfaces of the supporting rails 401 are matched through V-shaped surfaces, so as to guide and support the insulating pallet 201 and the forming groove 2 on the insulating pallet 201. An outer shape of a groove body at a top of the forming groove 2 matches an outer contour of the prefabricated sheet (rectangular in this embodiment). In actual use, the negative electrode of the pulse power generator 9 is connected with the forming groove 2, therefore effectively ensuring that the prefabricated sheet placed in the forming groove 2 is in a good energized state. The insulating pallet 201 is configured to insulate the forming groove 2 and the prefabricated sheet in the good energized state from the horizontal displacement device below, therefore ensuring safety of an equipment during operation. The backing plates (not shown in the attached drawings) are respectively embedded in an edge of the groove bottom of the forming groove 2. The backing plates are long strip plates with the same material and approximate thickness as the prefabricated sheet and located at the edge of the bottom surface of the prefabricated sheet. The backing plates are used to prevent edge ablation of to-be-processed sheets caused by temperature concentration at electrified positions during the direct contact electrification process, so as to ensure formation and uniformity of the gradient ultrafine-grained structure.

Hydraulic cylinders 3 are fixedly disposed on a top of the top plate 101. Output shaft ends of the hydraulic cylinders 3 are fixedly connected to a lifting frame plate 7 below the top plate 101. A pressure roller assembly 5 is rotatably disposed on the lifting frame plate 7. A pressure roller position-switching power device 6 is fixedly disposed on the lifting frame plate 7. The Hydraulic cylinders 3 are configured to drive the lifting frame plate 7 and the pressure roller assembly 5 and the pressure roller position-switching power device 6 on the lifting frame plate 7 to rise and fall synchronously, so that a certain pressure roller in the pressure roller assembly 5 applies preset pressing pressure on the surface of the sheet. The pressure roller position-switching power device 6 is configured to switch positions of each pressure roller in the pressure roller assembly 5 for performing corresponding rolling process.

In an embodiment, the lifting frame plate 7 is consisted of a horizontal mounting plate on the top and vertical side plates symmetrically and fixedly connected to two sides of a bottom surface of the horizontal mounting plate. The pressure roller assembly 5 includes a position-switching rotating shaft 501 rotatably connected to a bottom of the lifting frame plate 7, two position-switching rotating plates 502 respectively fixedly disposed on journals of the position-switching rotating shaft 501, the rib-forming pressure roller 503, the rib-flatting pressure roller 504 and the straightening pressure roller 505. Each of the rib-forming pressure roller 503, the rib-flatting pressure roller 504 and the straightening pressure roller 505 is rotatably disposed between the two position-switching rotating plates 502. Axes of the rib-forming pressure roller 503, the rib-flatting pressure roller 504 and the straightening pressure roller 505 are circumferentially and evenly distributed around an axis of the position-switching rotating shaft 501. The rib-forming pressure roller 503 is provided with the convex-concave textures on the cylindrical surface thereof; and each of the rib-flatting pressure roller 504 and the straightening pressure roller 505 has the smooth cylindrical surface.

Each of the shaft ends of the position-switching rotating shaft 501 is rotatably disposed on inner sides of the vertical side sheets on both sides of the position-switching rotating shaft 501 through rolling bearings. Stepped through-holes are defined at centers of inner end faces of the two position-switching rotating plates 502. The shaft ends of the position-switching rotating shaft 501 pass through the stepped through-holes, and axial positioning of the position-switching rotating shaft 501 is achieved by abutment of shaft shoulder end faces of the position-switching rotating shaft 501 against step faces of the stepped through-holes. Multiple connecting bolts evenly distributed around the stepped through-holes are disposed on outer side faces of the two position-switching rotating plates 502. Ends of the multiple connecting bolts are threadedly connected to the shaft shoulder end faces of the position-switching rotating shaft 501, therefore symmetrically and fixedly connecting the two position-switching rotating plates 502 to both ends of the position-switching rotating shaft 501. In an embodiment, the two position-switching rotating plates 502 have a regular triangle shape. Three bearing mounting holes are defined at three sharp corners of each of the two position-switching rotating plates 502, thereby forming three sets of bearing mounting holes. Each set of the three sets of bearing mounting holes consists of two bearing mounting holes respectively located in the two position-switching rotating plates 502. Axes of the three bearing mounting holes are circumferentially and evenly distributed around an axis of the stepped through-hole. Shaft ends on both sides of each of the rib-forming pressure roller 503, the rib-flatting pressure roller 504 and the straightening pressure roller 505 are rotatably installed in a corresponding one set of the three sets of bearing mounting holes through rolling bearings. In the embodiment, axial lengths of the rib-forming pressure roller 503, the rib-flatting pressure roller 504 and the straightening pressure roller 505 are equal. Radii of outer circular surfaces of the rib-forming pressure roller 503, the rib-flatting pressure roller 504 and the straightening pressure roller 505 are equal. The axial lengths are all not less than an inner width of the forming groove 2. After assembled on the two position-switching rotating plates 502, end faces of the rib-forming pressure roller 503, the rib-flatting pressure roller 504 and the straightening pressure roller 505 are also located in the same vertical plane, so that rolling surfaces of the rib-forming pressure roller 503, the rib-flatting pressure roller 504 and the straightening pressure roller 505 can completely cover the whole surface of the sheet. Coverage areas of contact positions of each pressure roller with the sheet are the same. In an embodiment, opposite end faces of the two position-switching rotating plates 502 are fixedly connected by three reinforcing rods 506. Each of the three reinforcing rod 506 is located in a gap position between two adjacent pressure rollers, forming a frame body structure, so as to enhance connection stability between the two position-switching rotating plates 502 and improve synchronization of the two position-switching rotating plates 502 during a rotating process.

The shaft ends on both sides of the rib-forming pressure roller 503 and the rib-flatting pressure roller 504 are connected with the positive electrode of the pulse power generator 9 by brushes, so as to ensure reliable electrification of the rib-forming pressure roller 503 and the rib-flatting pressure roller 504 in the rolling processes. The two position-switching rotating plates 502 are made of insulating materials (such as mica, ceramics, etc.) to ensure good insulation between the charged rib-forming pressure roller 503, rib-flatting roller 504 and external components, therefore ensuring the safety of the equipment during operation.

Power output ends of the pressure roller position-switching power device 6 are transmission-connected to ends of the position-switching rotating shaft 501. The pressure roller position-switching power device 6 is configured to drive the rib-forming pressure roller 503, the rib-flatting pressure roller 504 and the straightening pressure roller 505 to be sequentially positioned below the position-switching rotating shaft 501 and right above one end of a top surface of the prefabricated sheet. In an embodiment, the pressure roller position-switching power device 6 includes a position-switching drive motor 601, a transmission rotating shaft 602, a driving bevel gear 603, a driven bevel gear 604, first transmission gears 605 and second transmission gears 606. The position-switching drive motor 601 is fixedly disposed on a bottom surface on a top of the lifting frame plate 7. The transmission rotating shaft 602 is rotatably connected to the lifting frame plate 7. The driving bevel gear 603 is fixedly connected to an output shaft end of the position-switching drive motor 601. The driven bevel gear 604 is fixedly connected to the transmission rotating shaft 602 and meshed with the driving bevel gear 603. The first transmission gears 605 are fixedly connected to journals of the transmission rotating shaft 602. The second transmission gears 606 are fixedly connected to journals of the position-switching rotating shaft 501. The second transmission gears 606 are disposed outside the two position-switching rotating plates 502 and meshed with the first transmission gears 605. The position-switching drive motor 601 adopts a servo motor with a reducer. A motor mounting bracket 607 is fixedly disposed on middle part of the bottom surface of the horizontal mounting plate on the top of the lifting frame plate 7. The position-switching drive motor 601 is fixedly disposed in the motor mounting bracket 607. Output shaft of the position-switching drive motor 601 penetrates vertically downward to a lower part of the motor mounting bracket 607. In an embodiment, a through-hole is defined on center of a top surface of the horizontal mounting plate. A top part of the position-switching drive motor 601 is disposed in the through-hole to shorten a vertical distance between an axis of the transmission rotating shaft 602 and the bottom surface of the horizontal mounting plate, therefore making a structure more compact. Both ends of the transmission rotating shaft 602 are rotatably disposed on the vertical side plates on both sides through rolling bearings. The driven bevel gear 604 is welded and fixed at middle part of the transmission rotating shaft 602 to make transmission effects at both ends of the transmission rotating shaft 602 as symmetrical as possible.

The first transmission gears 605 and the second transmission gears 606 adopt a spur gear transmission pair. The reducer of the position-switching drive motor 601, bevel gear pair, and cylindrical spur gear pair constitute a three-stage deceleration transmission. The three-stage deceleration transmission meets requirements of spatial layout of a transmission structure. Further, the three-stage deceleration transmission can increase a transmission output torque, making position switching of the three pressure rollers of the pressure roller assembly 5 smoother. The first transmission gears 605 two in quantity are respectively sleeved on journals at both ends of the transmission rotating shaft 602. A sleeve is integrally disposed on one side end face of each of the first transmission gears 605. Axial position of the sleeve is positioned by shaft shoulder of the transmission rotating shaft 602, and the sleeve is tightened on the transmission rotating shaft 602 by multiple screws. The second transmission gears 606 two in quantity are respectively fixedly sleeved on the journals at both ends of the position-switching rotating shaft 501 through flat keys. Axial positions of the second transmission gears 606 are respectively positioned by shaft shoulders and retaining rings. In actual use, in an initial state, the rib-forming pressure roller 503 is located right below the position-switching rotating shaft 501 to perform the rib forming process. After the rib forming process is completed, the position-switching drive motor 601 drives the position-switching rotating shaft 501 to rotate 120 degrees (°), so that the rib-flatting pressure roller 504 replaces the rib-forming pressure roller 503 to be located right below the position-switching rotating shaft 501 to perform the rib flatting process. After the rib flatting process is completed, the position-switching drive motor 601 drives the position-switching rotating shaft 501 to rotate 120° again, so that the straightening pressure roller 505 is located right below the position-switching rotating shaft 501 to perform the cold straightening process.

A pattern of the convex-concave textures on the cylindrical surface of the rib-forming pressure roller 503 is any one selected from the group consisting of a straight-toothed pattern, an oblique-toothed pattern, a crossed mesh-toothed pattern, and a wolf-toothed pattern. In the embodiment, the pressing ribs are in a shape of strip straight teeth distributed along a generatrix direction of the rib-forming pressure roller 503. That is, a structure of the rib-forming pressure roller 503 is similar to a cylindrical spur gear.

To ensure that the two position-switching rotating plates 502 remain stable and unchanged during the rolling processes of each pressure roller, so as to ensure uniformity of the rolling processes, locking mechanisms 8 are fixedly disposed on the lifting frame plate 7. The locking mechanism 8 include locking cylinders 801 fixedly disposed on a top surface of the lifting frame plate 7 and locking plug rods 802 fixedly connected to output shaft ends of the locking cylinders 801. Plug connectors 803 are disposed on bottom ends of the locking plug rods 802. An outer edge surface of each of the two position-switching rotating plates 502 defines three plug-in grooves 5021. Each of the three plug-in grooves 5021 is matched with each of the plug connectors 803 and each of the plug connectors 803 is capable of being inserted into any one of the three plug-in grooves 5021. The three plug-in grooves 5021 are circumferentially and evenly distributed around the axis of the position-switching rotating shaft 501. In an embodiment, the locking mechanisms 8 are two groups in quantity, matched with the two position-switching rotating plates 502 and symmetrically arranged on both sides of the lifting frame plate 7. Cylinder mounting seats 804 are respectively fixedly connected to two sides of the top surface of the lifting frame plate 7 for mounting and fixing the locking cylinders 801 two in quantity. A bottom surface of the corresponding one of the plug connectors 803 is inserted into a top surface of each of the three plug-in grooves 5021 through a V-shaped surface, therefore achieving circumferential position locking of the two position-switching rotating plates 502. In an embodiment, two sides of a top surface of each of the locking plug rods 802 are respectively and fixedly provided with guiding bars 805 vertically distributed. The horizontal mounting plate of the lifting frame plate 7 is provided with guiding holes with shapes matched with a cross-sectional shape of the guiding bars 805. The guiding bars 805 are movably inserted into the guiding holes to guide and limit vertical liftings of the locking plug rods 802, so that the plug connectors 803 cannot move in a horizontal direction. In an embodiment, each of the locking plug rods 802 is provided with a waist-shaped through-hole. A width of the waist-shaped through-hole matches an outer diameter of corresponding position of the transmission rotating shaft 602. The corresponding position of the transmission rotating shaft 602 is movably inserted into the waist-shaped through-hole. The waist-shaped through-hole is configured to ensure that the transmission rotating shaft 602 will not interfere with the vertical liftings of a corresponding one of the locking plug rods 802. Further, horizontal displacement of the corresponding one of the locking plug rods 802 will be limited by fitting of the transmission rotating shaft 602 to a side wall of the waist-shaped through-hole.

Center part of the top surface of the lifting frame plate 101 is provided with through-holes, so that the locking cylinders 801 can movably penetrate through the through-holes. In this way, distance between a highest position of the lifting frame plate 7 and a bottom surface of the top plate 101 can be shortened as much as possible, therefore making a structure more compact and stable.

In actual use, the electrically-assisted tooth-shaped rolling device needs to be equipped with the pulse power generator 9, a logic controller, a hydraulic supply system and a pneumatic supply system, so as to realize power supply, electric energy supply and logic function control of the electrically-assisted tooth-shaped rolling device. The pulse power generator 9, the logic controller, the hydraulic supply system and the pneumatic supply system can adopt equipment in related art, and will not be described here. A use process of the electrically-assisted tooth-shaped rolling device is as follows.

Figure 2:
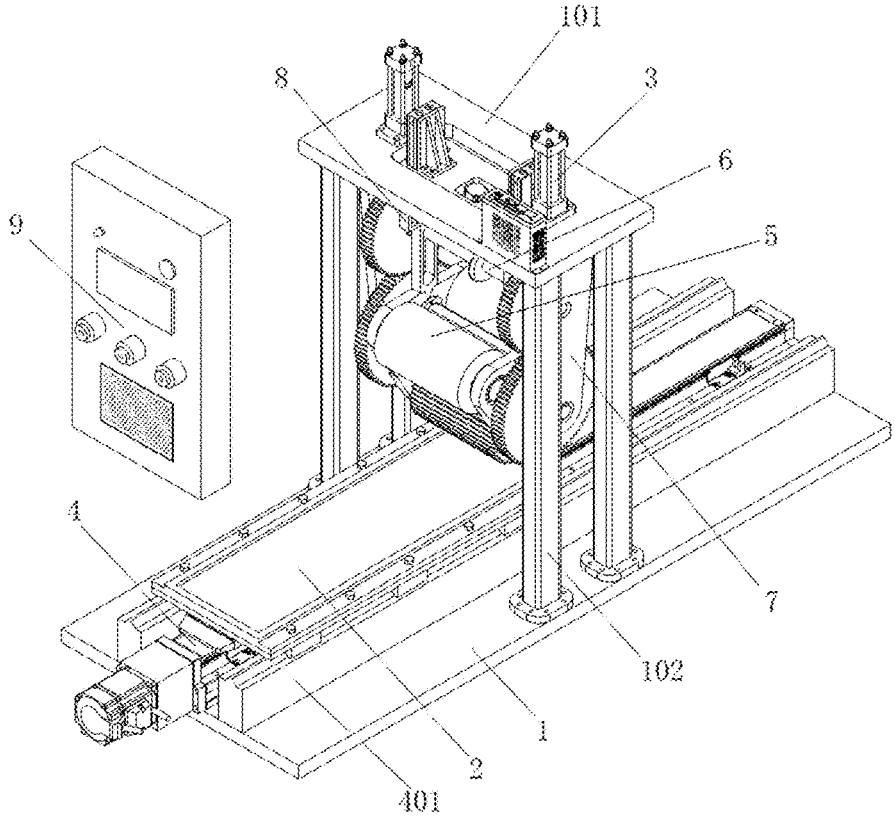
FIG. 2 illustrates a first perspective view of an electrically-assisted tooth-shaped rolling device according to the disclosure.
Figure 3:
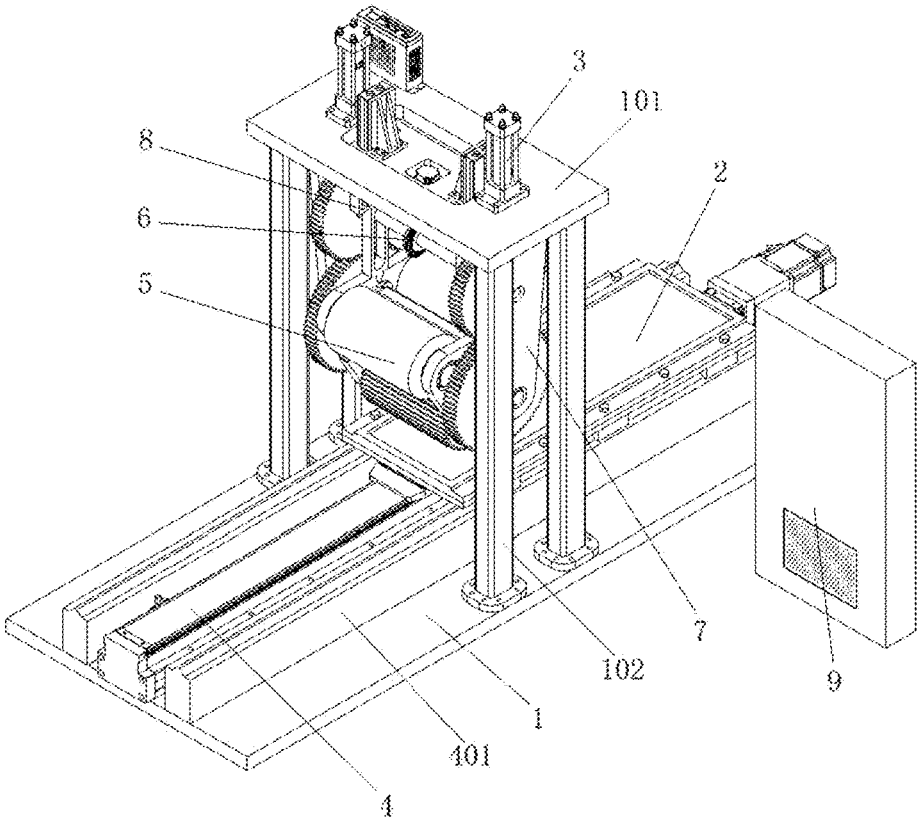
FIG. 3 illustrates a second perspective view of the electrically-assisted tooth-shaped rolling device according to the disclosure.
Figure 4:
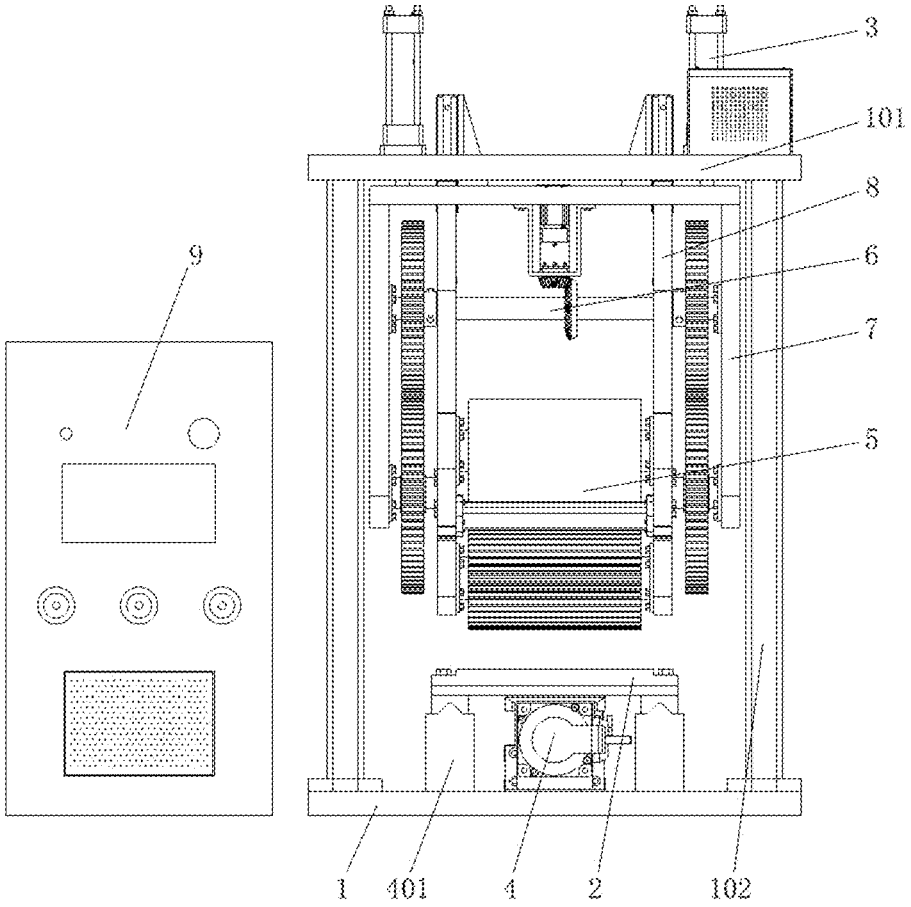
FIG. 4 illustrates a structural schematic diagram of the electrically-assisted tooth-shaped rolling device from a side view according to the disclosure.
Figure 5:
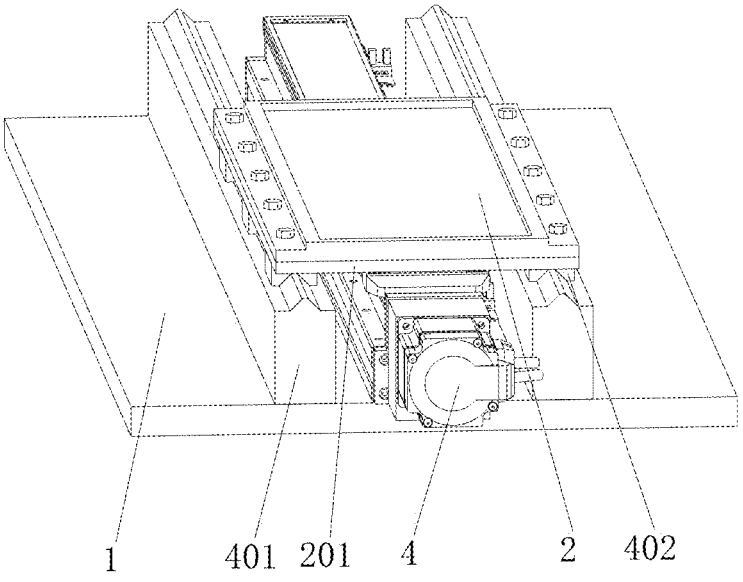
FIG. 5 illustrates a perspective view of a horizontal displacement device according to the disclosure.
Figure 6:
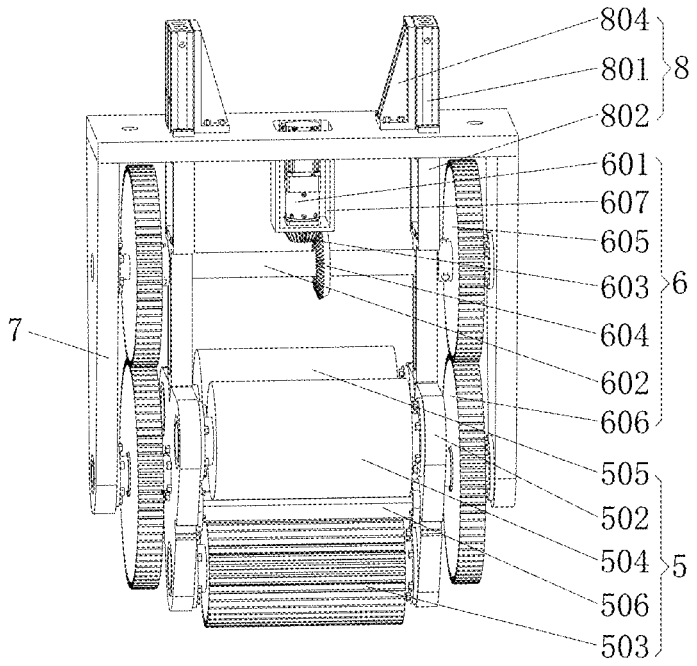
FIG. 6 illustrates a perspective view of a lifting frame plate and functional components thereon according to the disclosure.
Figure 7:
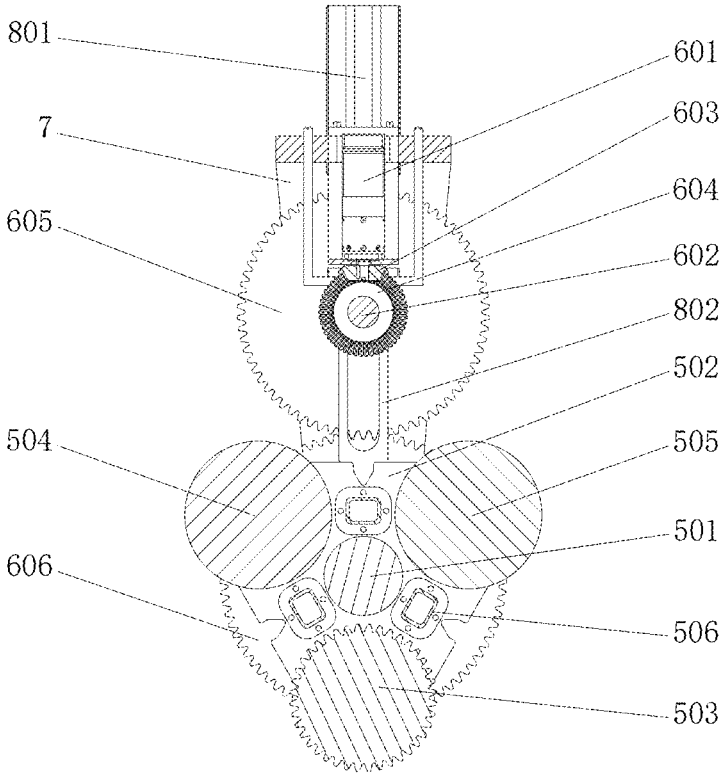
FIG. 7 illustrates a sectional view of the lifting frame plate and the functional components thereon according to the disclosure.
Figure 8:
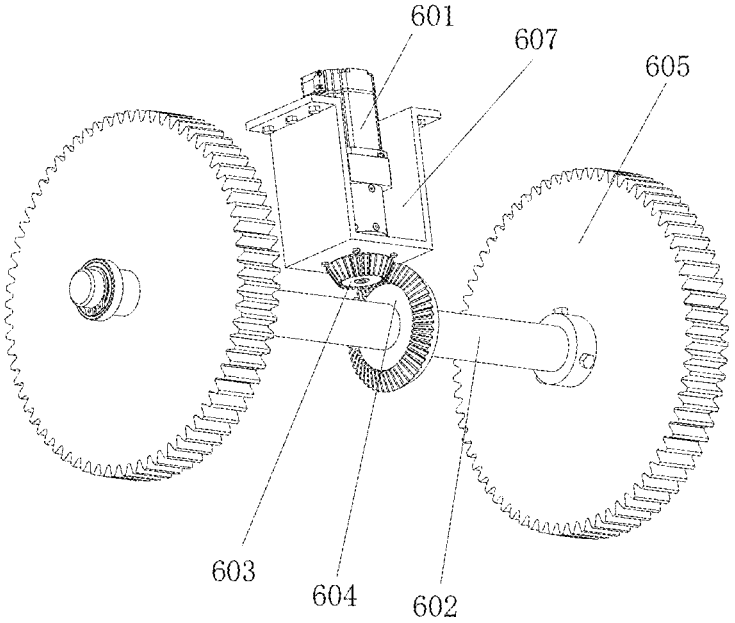
FIG. 8 illustrates a partial schematic structural diagram of a pressure roller position-switching power device according to the disclosure.
Figure 9:
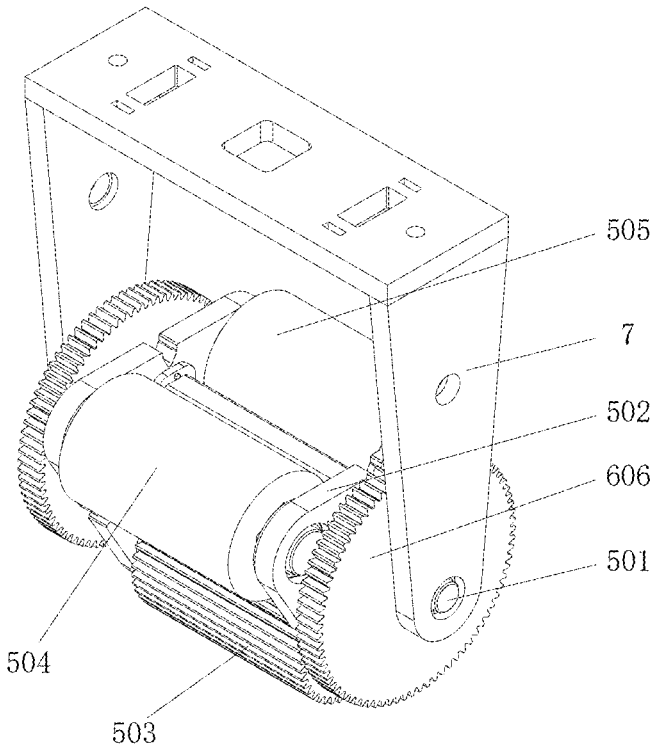
FIG. 9 illustrates a perspective view of a pressure roller assembly in an assembled state on the lifting frame plate according to the disclosure.
Figure 10:
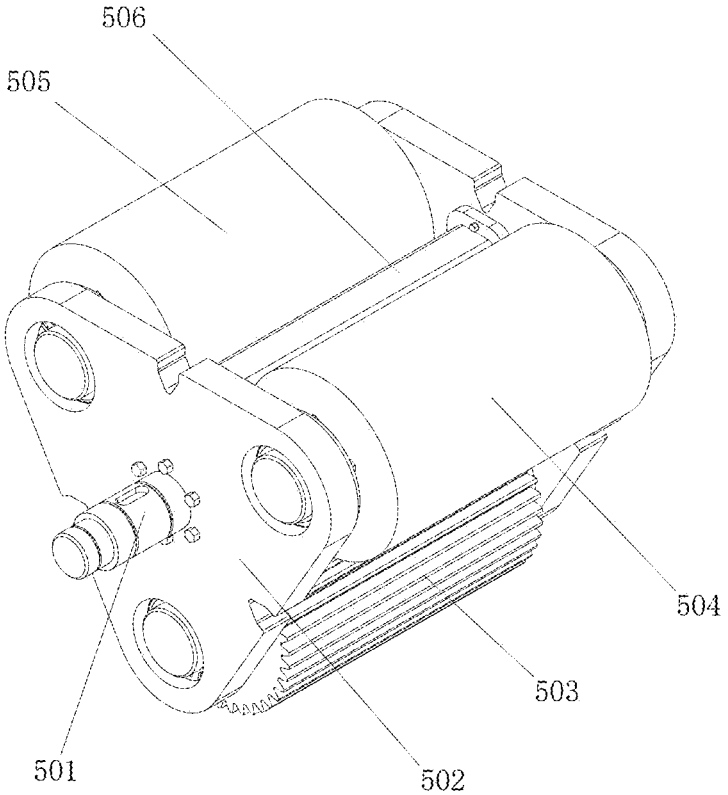
FIG. 10 illustrates a perspective view of the pressure roller assembly according to the disclosure.
Figure 11:
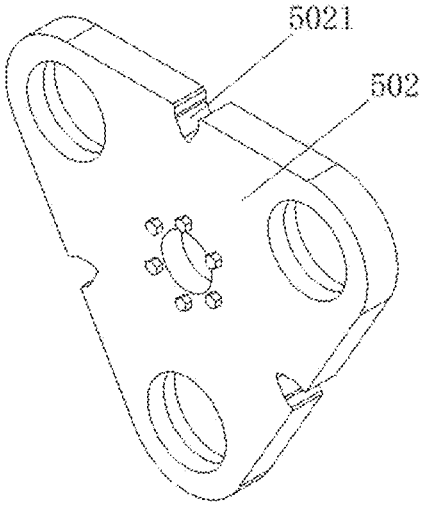
FIG. 11 illustrates a perspective view of a position-switching rotating shaft according to the disclosure.
Figure 12:
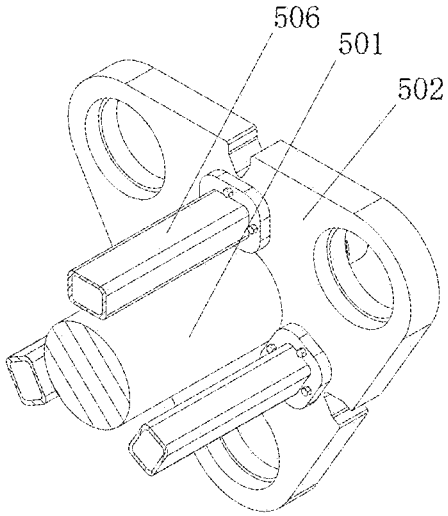
FIG. 12 illustrates a schematic structural diagram of a frame body of the pressure roller assembly according to the disclosure.
Figure 13:
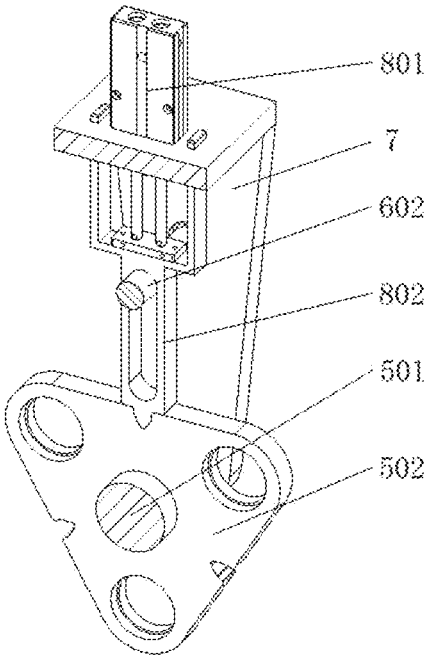
FIG. 13 illustrates a schematic diagram of a locking state of a locking mechanism with a position-switching rotating plate according to the disclosure.
Figure 14:
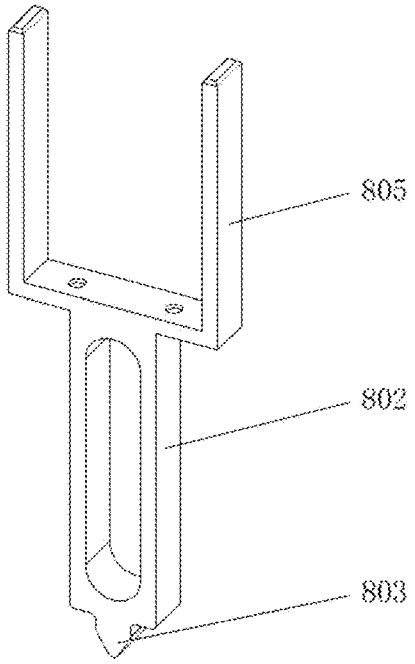
FIG. 14 illustrates a perspective view of a locking plug rod according to the disclosure.

In a first step, the electrically-assisted tooth-shaped rolling device is started, and a system is initialed to obtain an initial state. In the initial state, output rods of the hydraulic cylinders 3 are in retracted states, the lifting frame plate 7 is at the highest position thereof, and the rib-forming pressure roller 503 is located right below the position-switching rotating shaft 501 and suspended right above a right end of the groove body of the forming groove 2, as illustrated in FIG. 2.

In a second step, the prefabricated sheet is placed in the groove body of the forming groove 2. The pulse power generator 9 is started to work. Then an automatic execution program of roll forming operation is started.

In a third step, the logic controller controls the hydraulic cylinders 3 to work forward, pushing the lifting frame plate 7 to move downward until a lowest end of the cylindrical surface of the rib-forming pressure roller 503 contacts with a right end of a top surface of the prefabricated sheet and presses the prefabricated sheet. The logic controller controls the linear assembly 4 to work forward, driving the forming groove 2 and the prefabricated sheet thereon to move horizontally in a right direction. During a movement of the forming groove 2 and the prefabricated sheet, the pressing ribs on the surface of the rib-forming pressure roller 503 sequentially can be contact with an un-rolled surface of the prefabricated sheet on a left side of the prefabricated sheet. Local heating is caused at contact positions between the rib-forming pressure roller 503 and the prefabricated sheet due to the passage of current. After the relative rolling process between the rib-forming pressure roller 503 and the prefabricated sheet is completed, concave-convex textures are formed on the surface of the prefabricated sheet to thereby obtain the first loading step formed sheet with the concave-convex textures on a surface thereof.

In a fourth step, the logic controller respectively controls the hydraulic cylinders 3 and the linear assembly 4 to work backward and reset, driving the lifting frame plate 7 to rise and reset. Then, the logic controller controls the position-switching drive motor 601 to work, driving the position-switching rotating shaft 501 and the two position-switching rotating plates 502 to rotate counterclockwise by 120°, so that the rib-flatting pressure roller 504 is positioned right below the position-switching rotating shaft 501 and suspended right above the right end of the forming groove 2.

In a fifth step, the logic controller controls the hydraulic cylinders 3 to work forward again, pushing the lifting frame plate 7 to move downward until a lowest end of the smooth cylindrical surface of the rib-flatting pressure roller 504 contacts with the right end of the top surface of the first loading step formed sheet and presses the first loading step formed sheet. The logic controller controls the linear assembly 4 to work forward again, driving the forming groove 2 and the first loading step formed sheet thereon to move horizontally in the right direction. During a movement of the forming groove 2 and the first loading step formed sheet, the smooth cylindrical surface of the rib-flatting pressure roller 504 sequentially can be contact with convex parts on the top surface of the first loading step formed sheet. Local heating is caused at contact positions between the rib-flatting pressure roller 504 and the first loading step formed sheet due to the passage of current. After the relative rolling process between the rib-flatting pressure roller 504 and the first loading step formed sheet is completed, the concave-convex textures on the surface of the first loading step formed sheet are restored to the plane shape to thereby obtain the second loading step formed sheet.

In a sixth step, the logic controller respectively controls the hydraulic cylinders 3 and the linear assembly 4 to work backward and reset again, driving the lifting frame plate 7 to rise and reset. Then, the logic controller controls the position-switching drive motor 601 to work again, driving the position-switching rotating shaft 501 and the two position-switching rotating plates 502 to rotate counterclockwise by 120° again, so that the straightening pressure roller 505 is positioned right below the position-switching rotating shaft 501 and suspended right above the right end of the forming groove 2.

In a seventh step, the logic controller controls the hydraulic cylinder 3 to work forward for a third time, pushing the lifting frame plate 7 to move downward until a lowest end of the smooth cylindrical surface of the straightening pressure roller 505 contacts with the right end of the top surface of the second loading step formed sheet and presses the second loading step formed sheet. The logic controller controls the linear assembly 4 to work forward for the third time, driving the forming groove 2 and the second loading step formed sheet thereon to move horizontally in the right direction. During the movement, the smooth cylindrical surface of the straightening pressure roller 505 sequentially contacts with the top surface of the second loading step formed sheet to perform cold straightening on the second loading step formed sheet. After a relative rolling process between the straightening pressure roller and the second loading step formed sheet is completed, the sheet is restored to the flat state and the flatness of the surface of the sheet can be ensured.

In an eighth step, a recycle number of repeating a process of pressing-rib flatting-straightening can be set in the logical controller to continuously accumulate greater local plastic deformation, therefore precisely controlling grain size and thickness of an ultrafine-grained layer so as to obtain a required gradient ultrafine-grained sheet.

In a ninth step, after the rolling forming process is completed, the logic controller respectively controls the hydraulic cylinders 3 and the linear assembly 4 to work backward and reset for the third time, driving the lifting frame plate 7 to rise and reset. Then, the logic controller controls the position-switching drive motor 601 to work for the third time, driving the position-switching rotating shaft 501 and the two position-switching rotating plates 502 to rotate clockwise by 240° to reset the pressure roller assembly 5. The pulse power generator 9 is turned off. The gradient ultrafine-grained sheet formed is removed from the forming groove 2.

Figure 15:
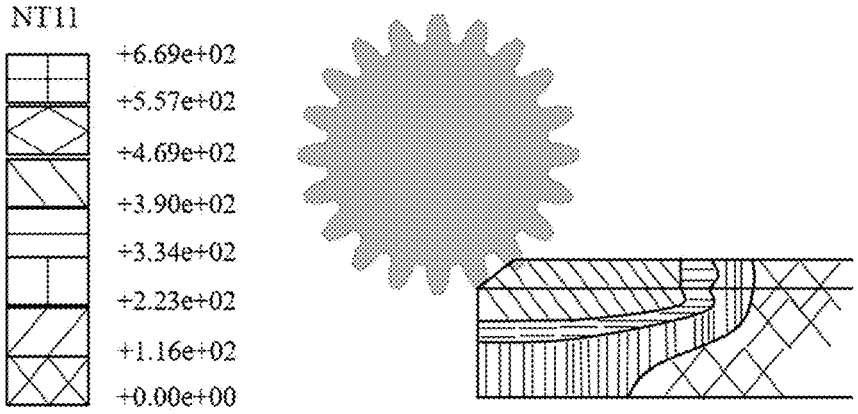
FIG. 15 illustrates a temperature distribution diagram of a rib forming process simulation according to the disclosure.
Figure 16:
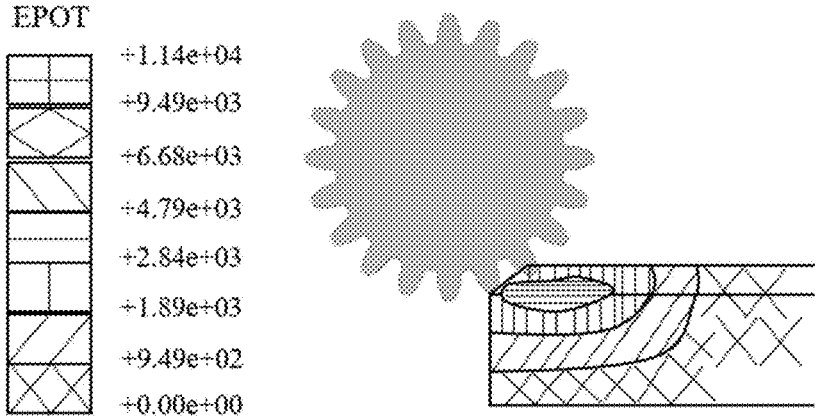
FIG. 16 illustrates an electric potential distribution diagram of the rib forming process simulation according to the disclosure.

FIG. 15 through FIG. 18 illustrate numerical simulation results of an electrically-assisted rolling forming process based on an Electromagnetic module of the ABAQUS® commercial finite element platform. FIG. 15 and FIG. 16 respectively illustrate a temperature distribution diagram and an electric potential distribution diagram of the rib forming process. Since the rib-forming pressure roller 503 is connected with the positive electrode of the pulse power generator 9 and the sheet is connected with the negative electrode of the pulse power generator 9, current will pass when the pressing ribs of the rib-forming pressure roller 503 contact the surface of the sheet. As a result, an obvious electric potential distribution will occur at contact positions, and a local high temperature will be formed in the contact positions namely deformation area, thereby improving formability of the deformation area.

Figure 17:
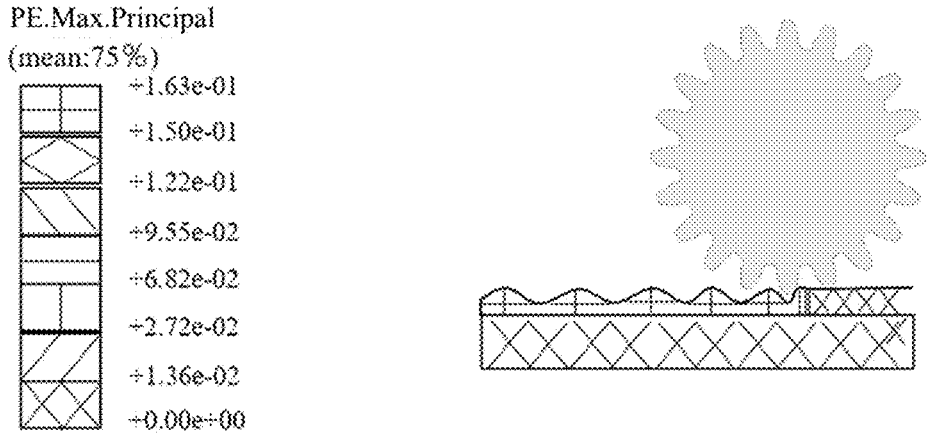
FIG. 17 illustrates an equivalent plastic strain diagram of the rib forming process simulation according to the disclosure.
Figure 18:
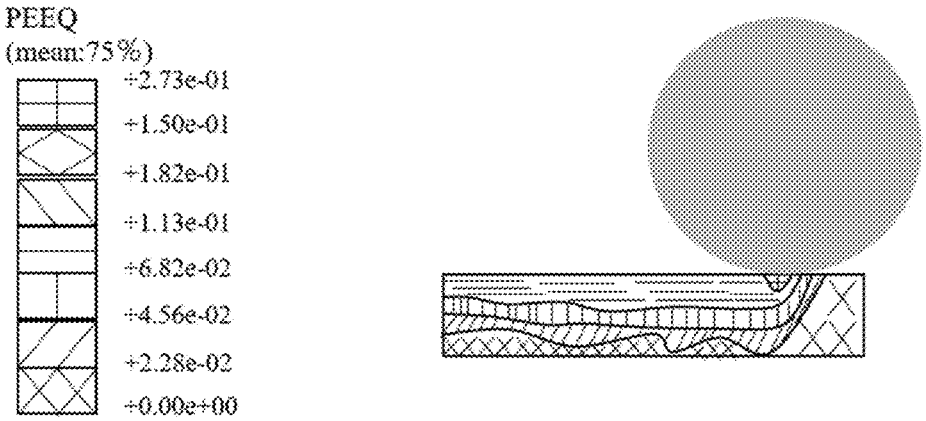
FIG. 18 illustrates an equivalent plastic strain diagram of a rib flatting process simulation according to the disclosure.

FIG. 17 illustrates an equivalent plastic strain diagram of the rib forming process. It can be seen that a deformation degree gradually decreases from the surface layer to the interior, facilitating to obtain the gradient grain structure aforementioned. FIG. 18 illustrates an equivalent plastic strain diagram of the rib flatting process. It can be seen that, a deformation degree of local area of the rolled sheet gradually decreases from a rolled surface to other surface, meeting conditions for the formation of gradient grain structure.

Embodiments described above are merely part of embodiments of the disclosure and are not to limit a scope of protection of the disclosure. Any equivalent structure or equivalent flow transformation based on contents of the specification and attached drawings of the disclosure, or applying the specification and attached drawings of the disclosure directly or indirectly in other related technical fields, are equally fall within the scope of protection of the disclosure.

What is claimed is:

1. An electrically-assisted tooth-shaped rolling process for preparing a gradient ultrafine-grained sheet, comprising the following steps:

S1, polishing a surface of a raw sheet to obtain a polished sheet; and then cutting the polished sheet to form a prefabricated sheet with a preset target shape;

S2, fixedly placing the prefabricated sheet in a forming groove (2) with a shape matched with the preset target shape of the prefabricated sheet; setting current parameters of a pulse power generator; and connecting the prefabricated sheet with a power output terminal of the pulse power generator (9);

S3, connecting a rib-forming pressure roller (503) with another power output terminal of the pulse power generator (9), the rib-forming pressure roller (503) being located above the prefabricated sheet and having convex-concave textures on a cylindrical surface thereof; driving, by a pressurizing device, the rib-forming pressure roller (503) to move downward until the cylindrical surface of the rib-forming pressure roller (503) is in contact with an end of a surface of the prefabricated sheet, to apply a first preset pressing force onto the prefabricated sheet;

S4, driving, by a horizontal displacement device, the forming groove (2) and the prefabricated sheet to move horizontally, thereby causing the rib-forming pressure roller (503) to roll relative to the surface of the prefabricated sheet until the rib-forming pressure roller (503) disengages from another end of the surface of the prefabricated sheet; wherein, in a relative rolling process between the rib-forming pressure roller (503) and the prefabricated sheet, pressing ribs on the cylindrical surface of the rib-forming pressure roller (503) sequentially contact with different positions on the surface of the prefabricated sheet, and local heating is caused at the different positions on the surface of the prefabricated sheet due to passage of current; and after the relative rolling process between the rib-forming pressure roller (503) and the prefabricated sheet is completed, concave-convex textures are formed on the surface of the prefabricated sheet to thereby obtain a first loading step formed sheet with the concave-convex textures on a surface thereof;

S5, connecting a rib-flatting pressure roller (504) with the another power output terminal of the pulse power generator (9), rib-flatting pressure roller (504) being located above the first loading step formed sheet and having a smooth cylindrical surface; and driving, by the pressurizing device, the rib-flatting pressure roller (504) to move downward until the smooth cylindrical surface of the rib-flatting pressure roller (504) is in contact with an end of the surface of the first loading step formed sheet, to apply a second preset pressing force onto the first loading step formed sheet;

S6, driving, by the horizontal displacement device, the forming groove (2) and the first loading step formed sheet to move horizontally, thereby causing the rib-flatting pressure roller (504) to roll relative to the surface of the first loading step formed sheet until the rib-flatting pressure roller (504) disengages from another end of the first loading step formed sheet; wherein, in a relative rolling process between the rib-flatting pressure roller (504) and the first loading step formed sheet, the smooth cylindrical surface of the rib-flatting pressure roller (504) sequentially contacts with convex parts at different positions on the surface of the first loading step formed sheet, and local heating is caused at the different positions on the surface of the first loading step formed sheet due to passage of current; and after the relative rolling process between the rib-flatting pressure roller (504) and the first loading step formed sheet is completed, the concave-convex textures on the surface of the first loading step formed sheet are restored to a plane shape to thereby obtain a second loading step formed sheet;

S7, driving, by the pressurizing device, a straightening pressure roller (505) with a smooth cylindrical surface and located above the second loading step formed sheet to move downward until the smooth cylindrical surface of the straightening pressure roller (505) is in contact with an end of a surface of the second loading step formed sheet, to apply a third preset pressing force onto the second loading step formed sheet;

S8, driving, by the horizontal displacement device, the forming groove (2) and the second loading step formed sheet to move horizontally, thereby causing the straightening pressure roller (505) to roll relative to the surface of the second loading step formed sheet until the straightening pressure roller (505) disengages from another end of the second loading step formed sheet; and performing, by the smooth cylindrical surface of the straightening pressure roller (505), cold straightening on the surface of the second loading step formed sheet to adjust a flatness of the surface of the second loading step formed sheet;

S9, repeating step S3 to step S8 for a preset number of cycles to complete a multi-pass rolling forming process so as to obtain the gradient ultrafine-grained sheet; and S10, turning off the pulse power generator (9), resetting the pressurizing device and the horizontal displacement device, and removing the gradient ultrafine-grained sheet from the forming groove (2).

2. The electrically-assisted tooth-shaped rolling process for preparing the gradient ultrafine-grained sheet as claimed in claim 1, wherein, in the step S2, the current parameters of the pulse power generator (9) are set as follows: 500 Hertz of a frequency, 20 amperes per square millimeter ($A/mm^2$)–30 $A/mm^2$ of a current density, and 75 microseconds of a duty cycle.

3. The electrically-assisted tooth-shaped rolling process for preparing the gradient ultrafine-grained sheet as claimed in claim 1, wherein, in the step S4, after the local heating is caused at the different positions on the surface of the prefabricated sheet due to the passage of current, a temperature at the different positions on the surface of the prefabricated sheet is in a range of 500 Celsius Degrees (° C.) to 800° C.

4. The electrically-assisted tooth-shaped rolling process for preparing the gradient ultrafine-grained sheet as claimed in claim 1, wherein, in the step S6, after the local heating is caused at the different positions on the surface of the first loading step formed sheet due to the passage of current, a temperature at the different positions on the surface of the first loading step formed sheet is in a range of 500° C. to 800° C.

5. The electrically-assisted tooth-shaped rolling process for preparing the gradient ultrafine-grained sheet as claimed in claim 1, wherein a radius difference of the convex-concave textures on the cylindrical surface of the rib-forming pressure roller (503) is in a range of ¼-⅓ of a thickness of the prefabricated sheet.

6. An electrically-assisted tooth-shaped rolling device for preparing a gradient ultrafine-grained sheet, applied to perform the electrically-assisted tooth-shaped rolling process for preparing the gradient ultrafine-grained sheet as claimed in claim 1, the electrically-assisted tooth-shaped rolling device comprising a bottom plate (1), a top plate (101) and the pulse power generator (9);

wherein the top plate (101) is fixedly disposed above the bottom plate (1) through support columns (102); a linear assembly (4) and supporting rails (401) are fixedly disposed on a top surface of the bottom plate (1), and the supporting rails (401) are respectively disposed at two sides of the linear assembly (4); the forming groove (2) is fixedly connected to a power output end on a top of the linear assembly (4); a bottom surface of the forming groove (2) is sliding overlapped on tops of the support rails (401); and the forming groove (2) is configured to place the prefabricated sheet to be processed and formed;

wherein hydraulic cylinders (3) are fixedly disposed on a top of the top plate (101); output shaft ends of the hydraulic cylinders (3) are fixedly connected to a lifting frame plate (7) below the top plate (101); a pressure roller assembly (5) is rotatably disposed on the lifting frame plate (7), and a pressure roller position-switching power device (6) is fixedly disposed on the lifting frame plate (7); the pressure roller assembly (5) comprises a position-switching rotating shaft (501) rotatably connected to a bottom of the lifting frame plate (7), two position-switching rotating plates (502) respectively fixedly disposed on journals of the position-switching rotating shaft (501) at both ends of the position-switching rotating shaft (501), the rib-forming pressure roller (503), the rib-flatting pressure roller (504), and the straightening pressure roller (505); each of the rib-forming pressure roller (503), the rib-flatting pressure roller (504) and the straightening pressure roller (505) is rotatably disposed between the two position-switching rotating plates (502); axes of the rib-forming pressure roller (503), the rib-flatting pressure roller (504) and the straightening pressure roller (505) are circumferentially and evenly distributed around an axis of the position-switching rotating shaft (501); the rib-forming pressure roller (503) is provided with the convex-concave textures on the cylindrical surface thereof; and each of the rib-flatting pressure roller (504) and the straightening pressure roller (505) has the smooth cylindrical surface;

wherein power output ends of the pressure roller position-switching power device (6) are transmission-connected to both ends of the position-switching rotating shaft (501); and the pressure roller position-switching power device (6) is configured to drive the rib-forming pressure roller (503), the rib-flatting pressure roller (504) and the straightening pressure roller (505) to be sequentially positioned below the position-switching rotating shaft (501) and right above an end of a top surface of the prefabricated sheet; and wherein the forming groove (2) is electrically connected with the power output terminal of the pulse power generator (9); the rib-forming pressure roller (503) and the rib-flatting pressure roller (504) are both electrically connected with the another power output terminal of the pulse power generator (9); the hydraulic cylinders (3) are configured to drive the pressure roller assembly (5) to move downward, to thereby make an outer cylindrical surface of any one of the rib-forming pressure roller (503), the rib-flatting pressure roller (504) and the straightening pressure roller (505) below the position-switching rotating shaft (501) be in contact with the surface of the prefabricated sheet, and apply a preset pressing force onto the prefabricated sheet; and the linear assembly (4) is configured to drive the forming grove (2) and the prefabricated sheet to move horizontally, to thereby make any one of the rib-forming pressure roller (503), the rib-flatting pressure roller (504) and the straightening pressure roller (505) in contact with the surface of the prefabricated sheet roll relative to the surface of the prefabricated sheet.

7. The electrically-assisted tooth-shaped rolling device for preparing the gradient ultrafine-grained sheet as claimed in claim 6, wherein the pressure roller position-switching power device (6) comprises:

a position-switching drive motor (601), fixedly disposed on a bottom surface on a top of the lifting frame plate (7);

a transmission rotating shaft (602), rotatably connected to the lifting frame plate (7);

a driving bevel gear (603), fixedly connected to an output shaft end of the position-switching drive motor (601);

a driven bevel gear (604), fixedly connected to the transmission rotating shaft (602) and meshed with the driving bevel gear (603);

first transmission gears (605), fixedly connected to journals of the transmission rotating shaft (602); and second transmission gears (606), fixedly connected to journals of the position-switching rotating shaft (501), wherein the second transmission gears (606) are disposed outside the two position-switching rotating plates (502) and meshed with the first transmission gears (605).

8. The electrically-assisted tooth-shaped rolling device for preparing the gradient ultrafine-grained sheet as claimed in claim 6, wherein locking mechanisms (8) are fixedly disposed on the lifting frame plate (7); the locking mechanisms (8) comprise locking cylinders (801) fixedly disposed on a top surface of the lifting frame plate (7) and locking plug rods (802) fixedly connected to output shaft ends of the locking cylinders (801); plug connectors (803) are disposed on bottom ends of the locking plug rods (802); an outer edge surface of each of the two position-switching rotating plates (502) defines three plug-in grooves (5021), each of the three plug-in grooves (5021) is matched with each of the plug connectors (803) and each of the plug connectors (803) is capable of being inserted into any one of the three plug-in grooves (5021); and the three plug-in grooves (5021) are circumferentially and evenly distributed around the axis of the position-switching rotating shaft (501).

9. The electrically-assisted tooth-shaped rolling device for preparing the gradient ultrafine-grained sheet as claimed in claim 6, wherein axial lengths of the rib-forming pressure roller (503), the rib-flatting pressure roller (504) and the straightening pressure roller (505) are equal, radii of outer circular surfaces of the rib-forming pressure roller (503), the rib-flatting pressure roller (504) and the straightening pressure roller (505) are equal, and the axial lengths are all not less than an inner width of the forming groove (2).

10. The electrically-assisted tooth-shaped rolling device for preparing the gradient ultrafine-grained sheet as claimed in claim 6, wherein a pattern of the convex-concave textures on the cylindrical surface of the rib-forming pressure roller (503) is any one selected from the group consisting of a straight-toothed pattern, an oblique-toothed pattern, a crossed mesh-toothed pattern, and a wolf-toothed pattern.

* * * * *